US005907941A

United States Patent [19]

Fukuzumi et al.

[11] Patent Number: 5,907,941

[45] Date of Patent: Jun. 1, 1999

[54] WEB ROLL WRAPPING APPARATUS

[75] Inventors: Tomio Fukuzumi; Tadao Tsuchiya, both of Minami-Ashigara, Japan

[73] Assignee: Fuji Photo Film Co., Ltd., Kanagawa, Japan

[21] Appl. No.: 08/956,427

[22] Filed: Oct. 23, 1997

[30] Foreign Application Priority Data

Oct. 28, 1996 [JP] Japan ..... 8-285487

[51] Int. Cl.[6] ..... B65B 61/00

[52] U.S. Cl. ..... 53/136.2; 53/370.2; 53/370.3; 53/372.5; 53/372.8

[58] Field of Search ..... 53/136.2, 370.2, 53/370.3, 372.5, 372.8, 372.9, 419, 116, 118

[56] References Cited

U.S. PATENT DOCUMENTS

| | | | |
|---|---|---|---|
| 3,924,375 | 12/1975 | Brenner et al. | 53/370.3 |
| 4,184,307 | 1/1980 | Kataoka | 53/372.9 |
| 4,362,001 | 12/1982 | Cockerham, Jr. et al. | 53/372.9 |
| 4,534,151 | 8/1985 | Schneck et al. | 53/136.2 |
| 4,845,919 | 7/1989 | Fujii et al. | 53/372.9 |
| 4,905,446 | 3/1990 | Dieckbernd et al. | 53/553 |
| 5,003,753 | 4/1991 | Dornblaser et al. | 53/136.2 |
| 5,015,430 | 5/1991 | Itoh et al. | 53/370.2 |
| 5,533,321 | 7/1996 | Hooper et al. | 53/136.2 |
| 5,546,729 | 8/1996 | Pienta | 53/136.2 |
| 5,570,569 | 11/1996 | Masuda | 53/552 |
| 5,572,848 | 11/1996 | Wall | 53/136.2 |

FOREIGN PATENT DOCUMENTS

| | | | |
|---|---|---|---|
| 8301429 | 4/1983 | European Pat. Off. | 53/372.9 |
| 63-168767 | 7/1988 | Japan | G06F 15/20 |
| 138582 | 11/1989 | Japan | G03C 3/00 |
| 405112337 | 5/1993 | Japan | 53/372.9 |

*Primary Examiner*—James F. Coan
*Assistant Examiner*—Gene L. Kim
*Attorney, Agent, or Firm*—Sughrue, Mion, Zinn Macpeak & Seas, PLLC

[57] ABSTRACT

A web roll wrapping apparatus comprises a shaft for holding a core of a photographic film roll, a folding unit for folding a protruding part of a light-shielding sheet wound around the photographic film roll, a heating unit for heat-sealing the folded part of the sheet, and a cooling unit for cooling the heat-sealed part of the sheet. The photographic film roll is rotated around the shaft, and the protruding part of the light-shielding sheet is folded down onto an end face of the photographic film roll by the folding unit. When passing the heating unit, the folded part is heat-sealed by a heating roller, and when passing the cooling unit, the heat-sealed part is cooled by a cooling roller to be prevented from loosening.

28 Claims, 11 Drawing Sheets

WEB ROLL WRAPPING APPARATUS

BACKGROUND OF THE INVENTION

1. Field of the Invention

The present invention relates generally to a web roll wrapping apparatus for wrapping a web roll in a sheet, and more particularly to a web roll wrapping apparatus for wrapping a roll of photosensitive web such as printing paper and photographic film (e.g. one in Japanese Utility Model Publication No. 1-38582) in a light-shielding sheet.

2. Description of Related Art

A photosensitive web is rolled and wrapped in a light-shielding sheet in a darkroom. The light-shielding sheet is wider than the roll of the photosensitive web, and is coated with a thermoplastic adhesive. The light-shielding sheet is wound at least once around the outer peripheral surface of the web roll, and protruding parts of the wound sheet, which parts protrude from both end faces of the web roll, are folded down at a right angle onto the end faces of the web roll. Then, the folded parts of the sheet are heat-sealed with the thermoplastic adhesive. Thus, the web roll is wrapped in the light-shielding sheet.

Japanese Patent Provisional Publication No. 63-168767 discloses an example of a conventional web roll wrapping apparatus which comprises a mechanism for holding and rotating the web roll, and folding members for folding and heat-sealing the protruding parts of the wound sheet. The wrapping apparatus rotates the web roll around its core with the holding mechanism, and moves the folding members, which are arranged at both ends of the web roll, back and forth in the diametrical direction of the web roll. Thereby, the protruding parts of the wound sheet are folded and heat-sealed by the folding members.

In the conventional wrapping apparatus, each folding member has both functions of folding and heating the protruding part of the wound sheet, and thus, it is difficult to position a heating means (a heater) on the folding member. For example, if the position of the heater on the folding member shifts toward the tip of the folding member, the end face of the web roll is harmfully heated, thereby damaging the photosensitive web.

Moreover, the conventional wrapping apparatus moves the folding members back and forth in the diametrical direction of the web roll. Thus, there is a disadvantage that an electric wire connected to the heater on the folding member may be broken.

SUMMARY OF THE INVENTION

The present invention has been developed in view of the above-described circumstances, and has as its object the provision of a web roll wrapping apparatus which is able to wrap the web roll without damaging the web roll.

To achieve the above-mentioned object, a web roll wrapping apparatus of the present invention for wrapping a web roll in a sheet, the web roll being composed of a web wound on a core, the sheet being wound around an outer peripheral surface of the web roll, the sheet being wider than the web roll and being previously coated with a thermoplastic adhesive, comprises: a roll holding member for holding the web roll by engaging with the core; a folding means for folding down a protruding part of the wound sheet, which part protrudes from an end face of the web roll, onto the end face of the web roll; a heating means for heating the folded part of the sheet so as to heat-seal the folded part with the thermoplastic adhesive, the heating means being arranged adjacent to the folding means; and the web roll wrapping apparatus is characterized in that the folding means folds down the protruding part of the wound sheet and the heating means heats the folded part of the sheet, while the roll holding member, the folding means and the heating means are moving relatively to one another.

According to the present invention, the folding means is constructed independently of the heating means. After the folding means folds down the protruding part of the wound sheet, the heating means heat-seals the folded part of the wound sheet. In the present invention, it is easier to position the folding means and the heating means, compared to the conventional apparatus in which the heating means is integrated with the folding means. Thus, it is possible to wrap the web roll without damaging the web roll.

According to the present invention, the folding means folds down the protruding part of the wound sheet and the heating means heat-seals the folded part of the sheet, while the driving means rotates the roll holding member and/or the tool supporting member, which supports the folding means and the heating means, around the core of the web roll. Thus, the web roll can be wrapped efficiently.

According to the present invention, the cooling means arranged adjacent to the heating means rapidly cools the folded part which is heat-sealed by the heating means. Thus, the heat-sealed part can be prevented from loosening, and the web roll can be wrapped without fail.

According to the present invention, the folding means, the heating means and the cooling means are provided so that they can move forward and backward with respect to the roll holding member. When the roll holding member holds the web roll, the folding means, the heating means and the cooling means wait at retracted positions so as not to interfere with the holding of the web roll.

According to the present invention, the positioning members are provided at the folding means, the heating means and the cooling means, respectively. When the folding means, the heating means or the cooling means moves toward the roll holding member, each positioning member abuts against the outer peripheral surface of the roll of the sheet wound around the web roll. In this case, the positioning member of the folding means positions the folding means at the protruding part of the wound sheet. Then, the positioning member of the heating means positions the heating means at the folded part of the sheet. Likewise, the positioning member of the cooling means positions the cooling means at the heated part of the sheet. Thus, it is possible to easily and correctly position the folding means, the heating means and the cooling means.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will be described in further detail by way of example with reference to the accompanying drawings.

Figure 1:
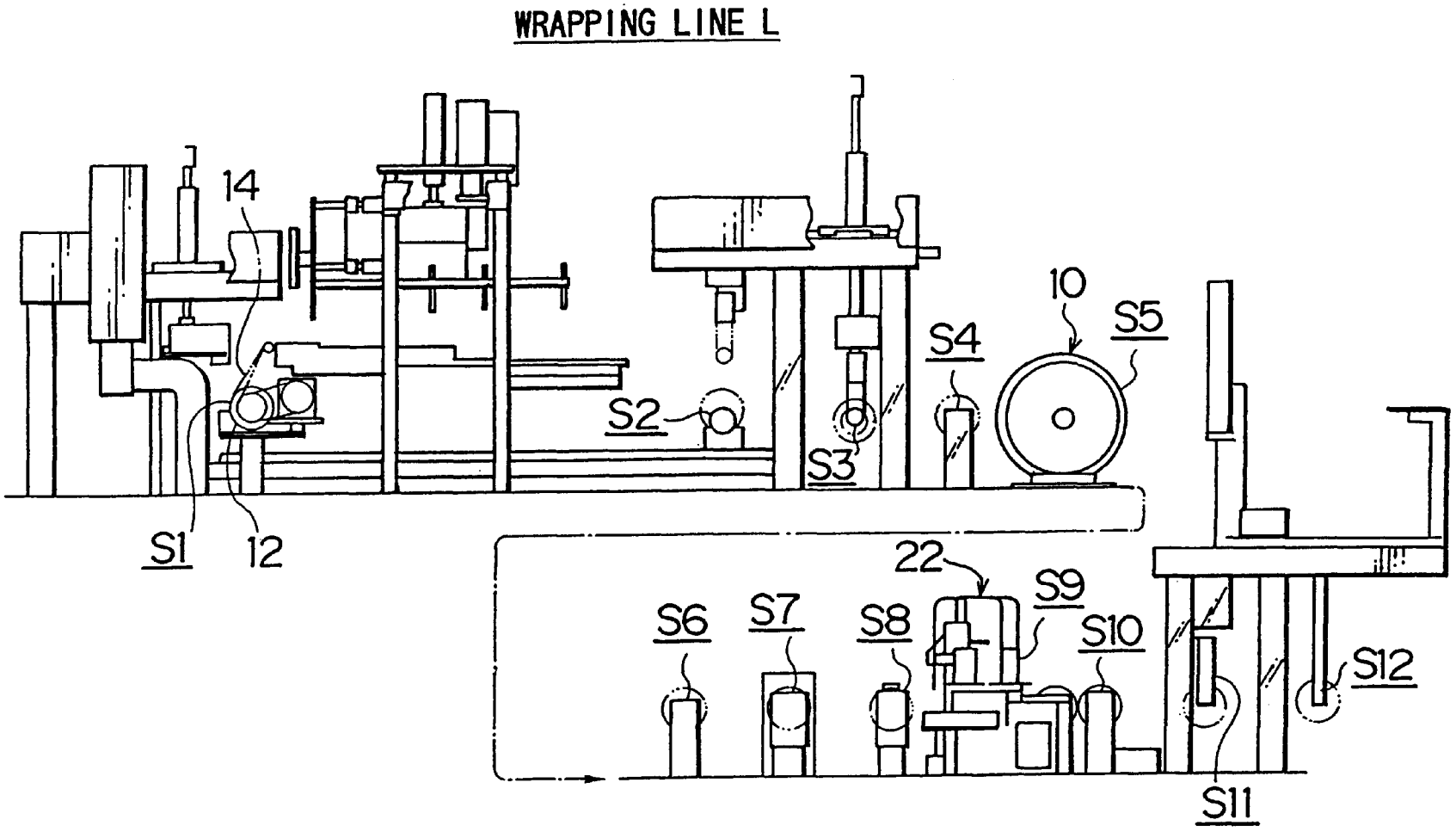
FIG. 1 is a side view describing a wrapping line for photographic film rolls.
Figure 2:
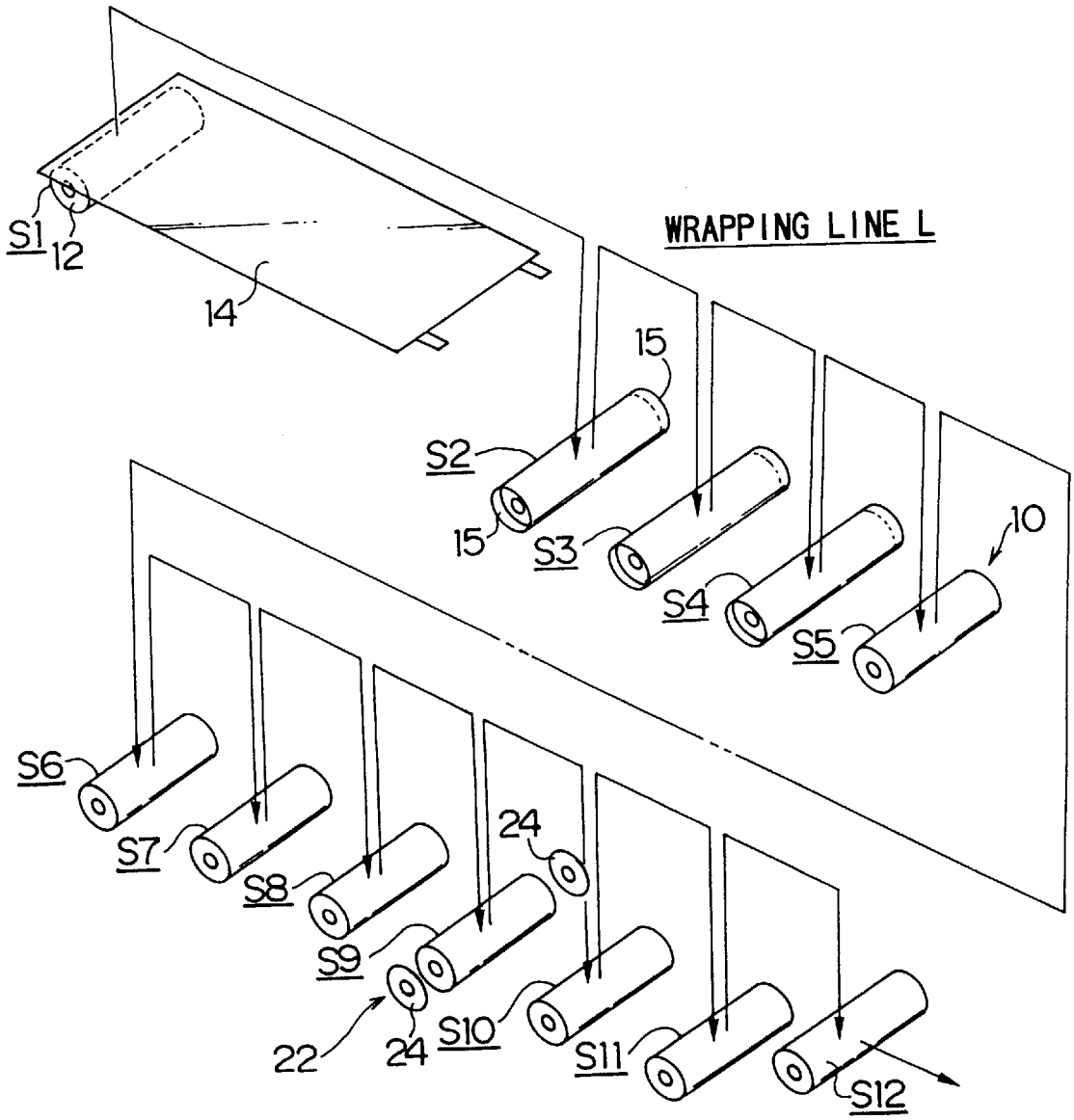
FIG. 2 is a perspective view describing stations in the wrapping line shown in FIG. 1.

FIG. 1 is a side view describing a wrapping line L for a photographic film roll in which a web roll wrapping apparatus according to the present invention is applied. FIG. 2 is a view describing stations S1–12, which compose the wrapping line L.

As shown in FIGS. 1 and 2, the outer peripheral surface of a photographic film roll (a web roll) 12 is wound with a light-shielding sheet (a sheet) 14 at the station S1.

Figure 3:
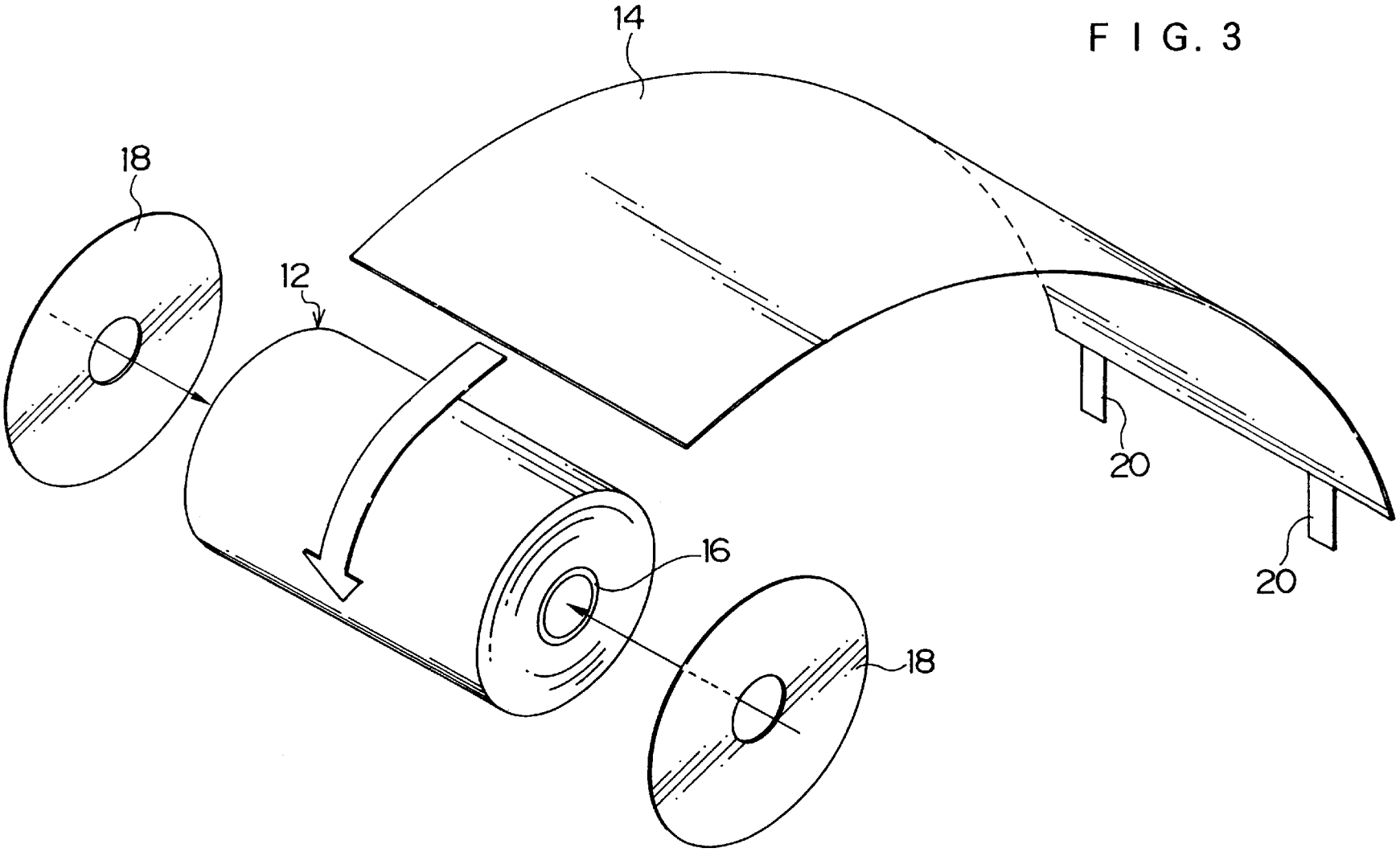
FIG. 3 is a perspective view describing a state where a light-shielding sheet is wound around the photographic film roll.
Figure 4:
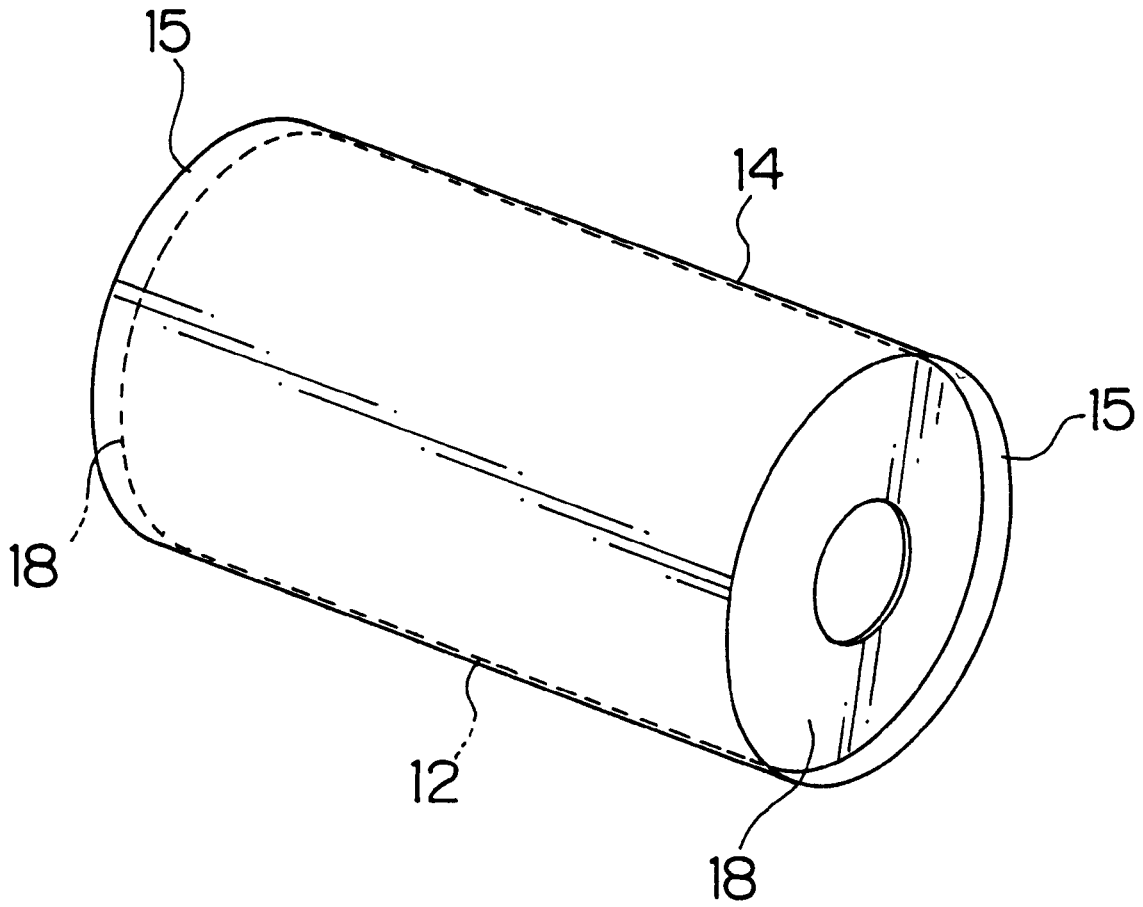
FIG. 4 is a perspective view describing a state where the light-shielding sheet is wound in cylindrical form around the photographic film roll.

FIG. 3 is a perspective view describing a state where the photographic film roll 12 is wound with the light-shielding sheet 14. As shown in FIG. 3, the photographic film roll 12 is wound around a hollow core 16, and disk light-shielding sheets (hereinafter referred to as "inner seals") 18 are stuck on both end faces of the photographic film roll 12 in a pre-processing treatment. The photographic film roll 12 is transported to the station S1, and then the outer peripheral surface of the photographic film roll 12 is wound with a rectangular light-shielding sheet 14 which is ready at the station S1. The light-shielding sheet 14 is wider than the photographic film roll 12, and is coated with a thermoplastic adhesive. The light-shielding sheet 14 is fixed with adhesive tapes 20 in a state of cylindrically covering the outer peripheral surface of the photographic film roll 12 as shown in FIG. 4. In FIG. 4, protruding parts 15 of the wound light-shielding sheet 14 protrude from both ends of the photographic film roll 12, that is, the circumferences of the inner seals 18.

The photographic film roll 12 which was wound with the light-shielding sheet 14 at the station S1 is transported to the wrapping apparatus 10 at the station S5 through the stations S2–4 as indicated by arrows in FIG. 2. In the wrapping apparatus 10, folding units (folding means) fold down the protruding part 15 of the light-shielding sheet 14, heating units (heating means) heat the folded part, which was originally the protruding part 15, so as to heat-seal the folded part with the thermoplastic adhesive, and cooling units (cooling means) cool the heated part. The wrapping apparatus 10 will be described later.

After passing through the wrapping apparatus 10, the photographic film roll 12 is held at the station S6, and a heater (not shown) further heat-seals the folded parts at the station S7, and a cooler (not shown) cools the folded parts at the station S8. Then, outer seals 24 are stuck on the folded parts and the inner seals 18 at both ends of the photographic film roll 12 by an outer seal sticking apparatus 22 at the station S9. The sticking apparatus 22 will be described later. As is the case with the light-shielding sheet 14, the outer seal 24 is coated with the thermoplastic adhesive. A heater (not shown) heats the outer seals 24 at the station S9, and a cooler (not shown) cools the outer seals 24 at the station S10. Thus, the outer peripheral surface of the photographic film roll 12 is wrapped in the light-shielding sheet 14, and both ends of the photographic film roll 12 are wrapped with the inner seals 18 and the outer seals 24. Then, the photographic film roll 12 is transported to the outside of the wrapping line L via the station S12.

Figure 5:
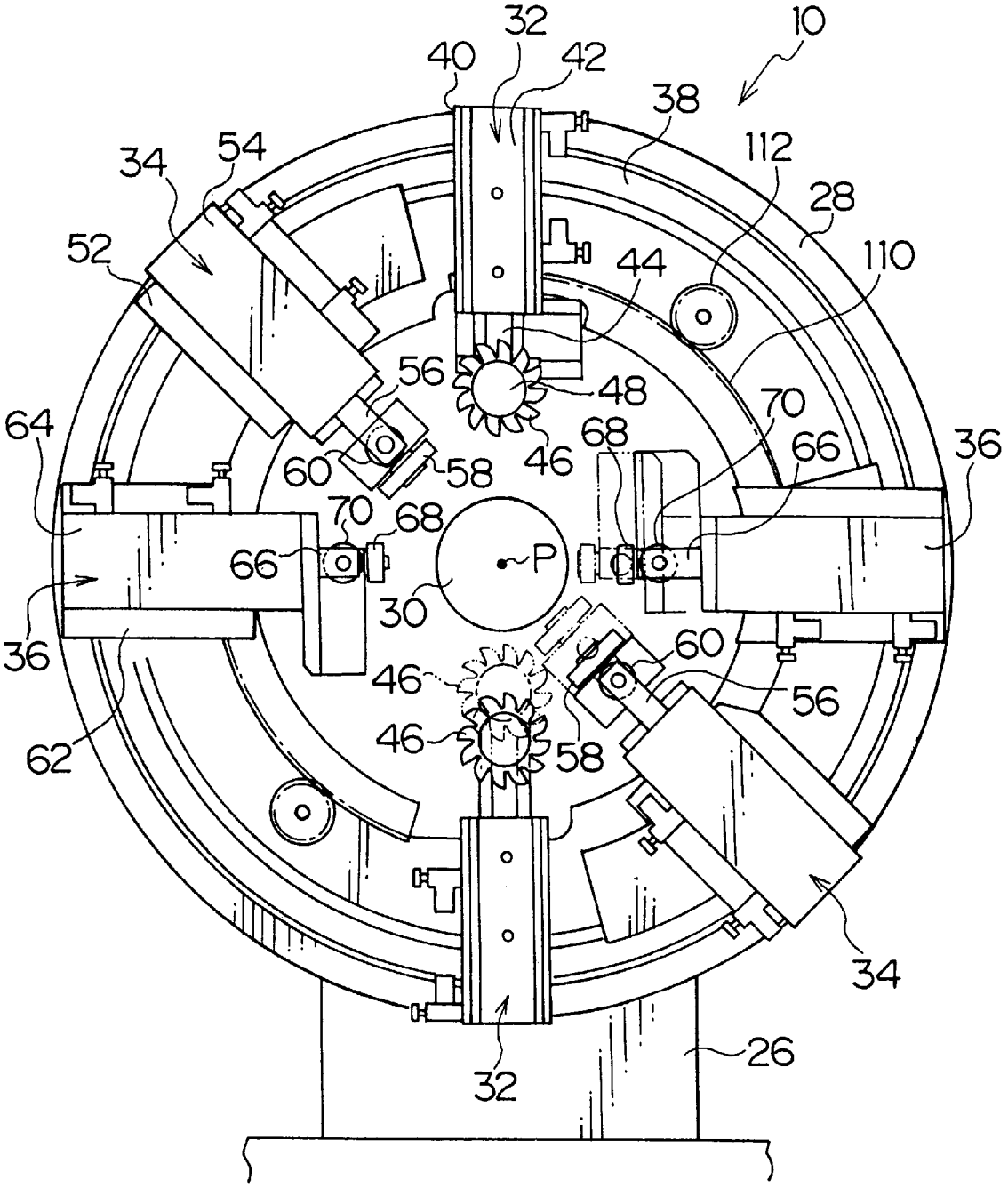
FIG. 5 is a front view of a wrapping apparatus according to the present invention.
Figure 6:
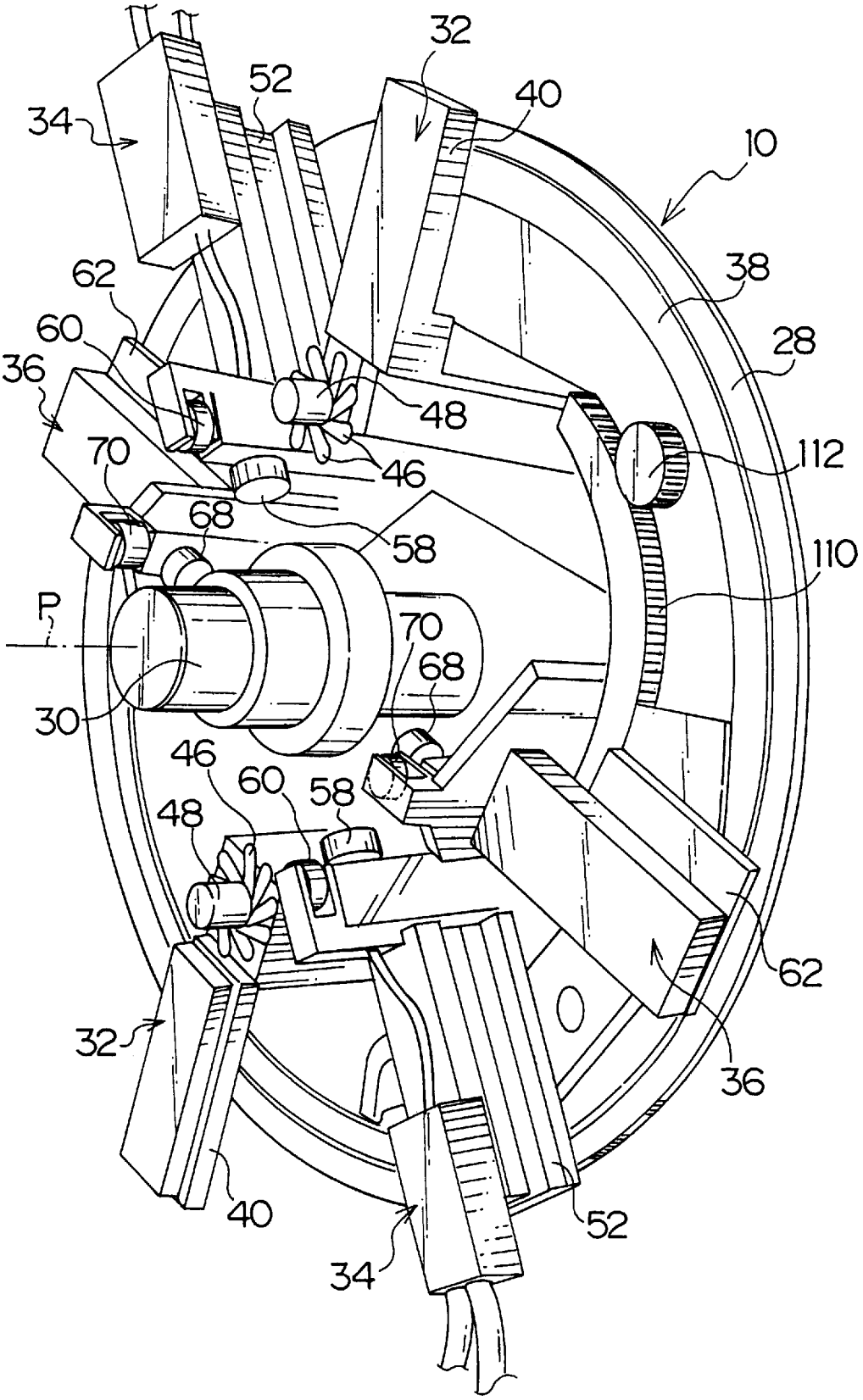
FIG. 6 is a perspective view of the wrapping apparatus shown in FIG. 5.

FIG. 5 is a front view of the wrapping apparatus 10, and FIG. 6 is a perspective view of the wrapping apparatus 10. In this embodiment, two pieces of the wrapping apparatus 10 are respectively arranged opposite to both ends of the photographic film roll 12. Since the two pieces of wrapping apparatus 10 have the same structure, only one of them will be explained.

In FIG. 5, the wrapping apparatus 10 is fixed on a column 26 in the wrapping line L. As shown in FIGS. 5 and 6, the wrapping apparatus 10 is provided with a ring-shaped tool support plate (a tool supporting member) 28, and a roll holding shaft (a roll holding member) 30 projecting from the opening at the center of the tool support plate 28. The shaft 30 holds the end of the core 16 (see FIG. 3) of the photographic film roll 12. The shaft 30 is rotated by a motor (not shown), and is moved forward and backward along its axis P by a forward/backward movement mechanism (not shown). Thus, the photographic film roll 12 which is held by the shaft 30 is rotated by the motor and is attached to and detached from the wrapping apparatus 10 by the forward/backward movement mechanism.

The folding units 32, the heating units 34 and the cooling units 36 are arranged on the tool support plate 28. Two same units are arranged symmetrically with respect to the shaft 30. The units 32, 34, 36 are engaged with a circular guide rail (a convex) 38 on the surface of the tool support plate 28. The guide rail 38 is formed around the axis P of the shaft 30. By sliding the units 32, 34, 36 along the guide rail 38, the positions of the units 32, 34, 36 can be adjusted around the axis P. A slide mechanism for the units 32, 34, 36 consists of an arc rack 110 and a pinion 112. When drive force of the pinion 112 rotates the rack 110, the units 32, 34, 36, which are fixed on the same member (not shown) as the rack 110, rotate around the axis P.

Figure 7:
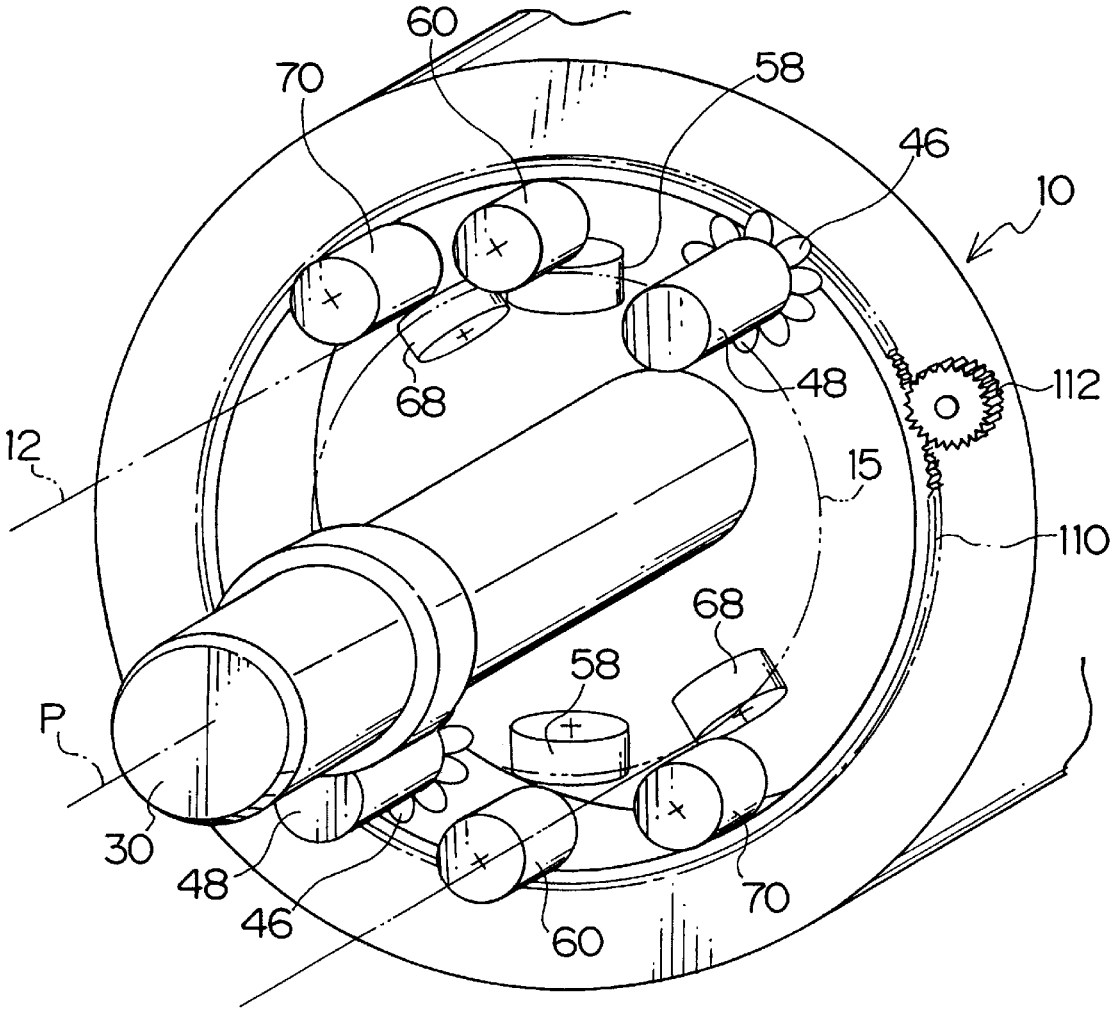
FIG. 7 is a view describing positional relations between units which compose the wrapping apparatus.
Figure 8:
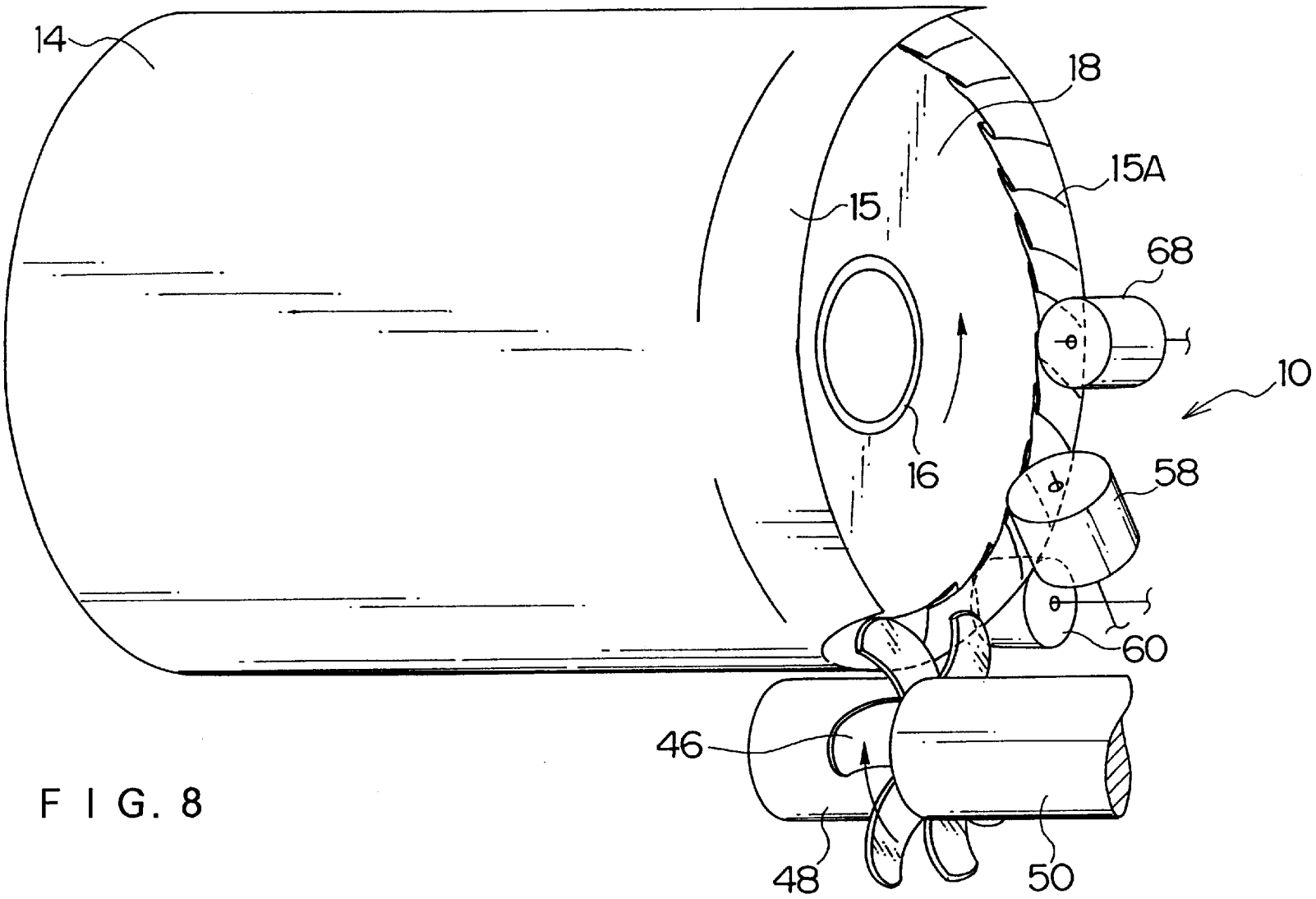
FIG. 8 is a view describing the action of the units in the wrapping apparatus.

In FIG. 5, the folding unit 32 has a support plate 40 engaged with the guide rail 38, and an air cylinder 42 is fixed on the support plate 40. The air cylinder 42 is fixed at such a position that a rod 44 thereof can extend and contract in the radial direction from the axis P of the shaft 30, that is, in the diametrical direction of the photographic film roll 12. Folding blades 46 and a stopper roller (a positioning member) 48 are provided at the end of the rod 44. As shown in FIGS. 7 and 8, when the rod 44 extends, the folding blades 46 abut against the protruding part 15 of the light-shielding sheet 14. When a motor 50 in FIG. 8 rotates the folding blades 46 in the direction of an arrow in FIG. 8, the folding blades 46 fold down the protruding part 15 onto the end face of the photographic film roll 12. When the rod 44 extends, the stopper roller 48 abuts against the outer peripheral surface of the roll of the light-shielding sheet 14. Thereby, the folding blades 46 are positioned at the protruding part 15 of the light-shielding sheet 14 as shown in FIGS. 7 and 8.

In FIG. 5, the heating unit 34 has a support plate 52 engaged with the guide rail 38, and an air cylinder 54 is fixed on the support plate 52. The air cylinder 54 is fixed at such a position that a rod 56 thereof can extend and contract in the radial direction from the axis P of the shaft 30, that is, in the diametrical direction of the photographic film roll 12. A heating roller 58 and a stopper roller (a positioning member) 60 are provided at the end of the rod 56. The heating roller 58 is maintained at a proper high temperature by a built-in heating wire (not shown). As shown in FIGS. 7 and 8, when the rod 56 extends, the heating roller 58 abuts against a folded part 15A of the light-shielding sheet 14, which part was originally the protruding part 15 and was folded by the folding blades 46, and the heating roller 58 heats the folded part 15A. Thereby, the folded part 15A is heat-sealed with the thermoplastic adhesive coated thereon. When the rod 56 extends, the stopper roller 60 abuts against the outer peripheral surface of the roll of the light-shielding sheet 14. Thereby, the heating roller 58 is positioned at the folded part 15A of the light-shielding sheet 14 as shown in FIGS. 7 and 8.

In FIG. 5, the cooling unit 36 has a support plate 62 engaged with the guide rail 38, and an air cylinder 64 is fixed on the support plate 62. The air cylinder 64 is fixed at such a position that a rod 66 thereof can extend and contract in the radial direction from the axis P of the shaft 30, that is, in the diametrical direction of the photographic film roll 12. A cooling roller 68 and a stopper roller (a positioning member) 70 are provided at the end of the rod 66. The cooling roller 68 is maintained at room temperature. As shown in FIGS. 7 and 8, when the rod 66 extends, the cooling roller 68 abuts against the folded part 15A which is heat-sealed by the heating roller 58. When the rod 66 extends, the stopper roller 70 abuts against the outer peripheral surface of the roll of the light-shielding sheet 14. Thereby, the cooling roller 68 is positioned at the folded part 15A of the light-shielding sheet 14 as shown in FIGS. 7 and 8.

A control unit (not shown) controls the extension and contraction timing of the rods 44, 56, 66 of the folding unit 32, the heating unit 34 and the cooling unit 36.

Figure 9:
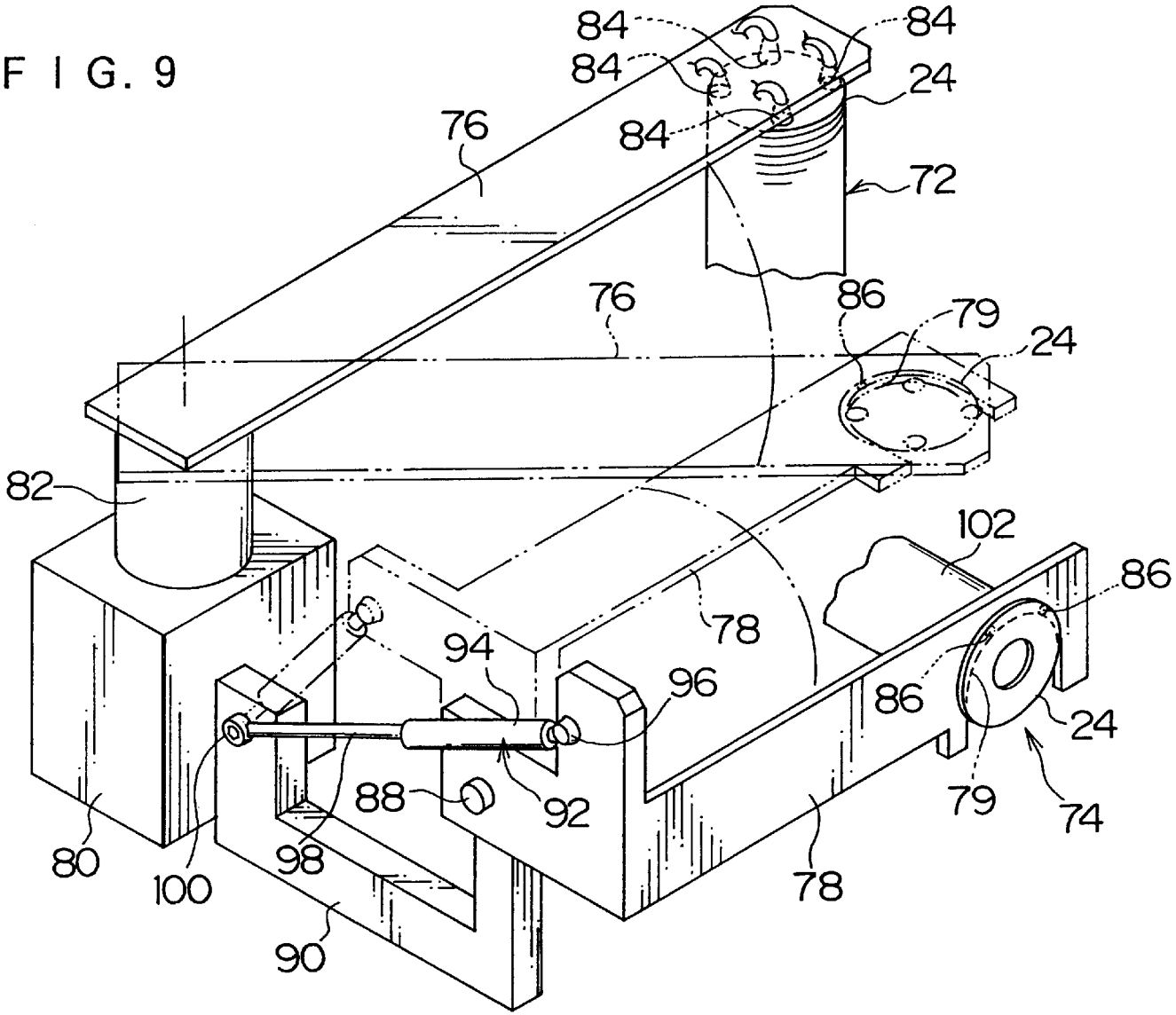
FIG. 9 is a perspective view describing the essential parts of an outer seal sticking apparatus.

FIG. 9 is a perspective view describing the essential parts of the outer seal sticking apparatus 22. As is the case with the pieces of wrapping apparatus 10, two pieces of the sticking apparatus 22 are respectively arranged opposite to both ends of the photographic film roll 12. Since the two pieces of sticking apparatus 22 have the same structure, only one of them will be explained.

As shown in FIG. 9, the sticking apparatus 22 is provided with two arms 76, 78, which transport the outer seal 24 from a stack position 72 to a pressing position 74.

The left end of the arm 76 is fixed to a spindle 82 of a motor 80, and four holding pads 84 are arranged on the bottom face of the right end of the arm 76. The outer seals 24 are vertically stacked up at the stack position 72 at the outside of the wrapping line L, and the top outer seal 24 is sequentially held by the holding pads 84 of the arm 76. Then, the held outer seal 24 is transported to holding pads 86 of the arm 78 by clockwise rotational movement of the arm 76.

The L-shaped left side of the arm 78 is rotatably supported by a support base 90 with a shaft 88. The shaft 88 is arranged perpendicularly to the spindle 82 of the motor 80. Thus, the arm 78 is capable of being raised and laid on the shaft 88 in a range between a position to receive the outer seal 24 from the arm 76 which is represented with alternate long and two short dashes lines in FIG. 9, and the pressing position 74 represented with solid lines.

An air cylinder 92 which raises and lays the arm 78 is attached in such a way that the base end of a cylinder 94 is supported by the left side of the arm 78 rotatably around a shaft 96, and the end of a rod 98 is supported by the support base 90 rotatably around a shaft 100. Thus, when the rod 98 contracts, the arm 78 moves to the position to receive the outer seal 24 from the arm 76, and when the rod 98 extends, the arm 78 moves to the pressing position 74.

Figure 10:
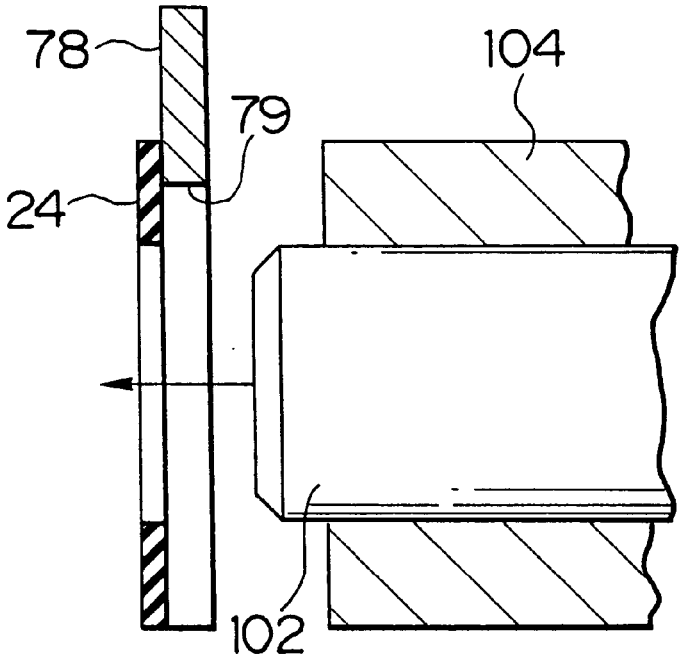
FIG. 10 is a view of assistance for explaining the attachment of the outer seal by the sticking apparatus.
Figure 11:
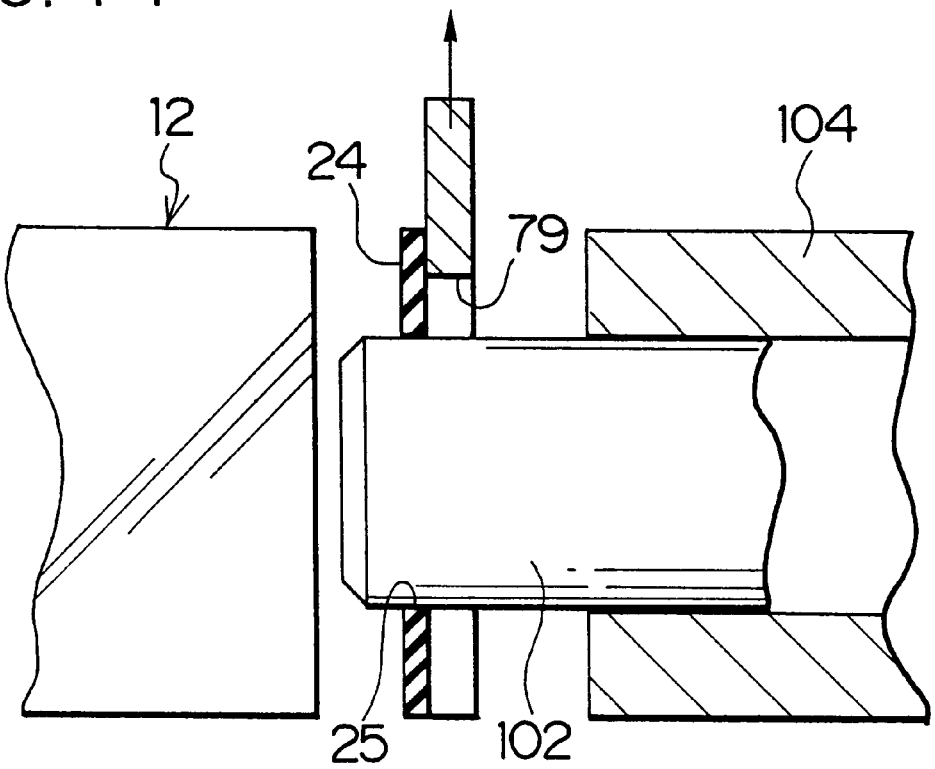
FIG. 11 is a view of assistance for explaining the attachment of the outer seal by the sticking apparatus.

The right end 79 of the arm 78, which holds the outer seal 24, is U-shaped. When the arm 78 is positioned at the pressing position 74, the end 79 faces a outer seal holding shaft 102 as shown in FIG. 9. As shown in FIG. 10, the holding shaft 102 is capable of extending and contracting inside a cylindrical press shaft 104. When the holding shaft 102 extends in the first step of extension, the holding shaft 102 is inserted into the opening 25 at the center of the outer seal 24 via the U-shaped space of the end 79 as shown in FIG. 11.

Figure 12:
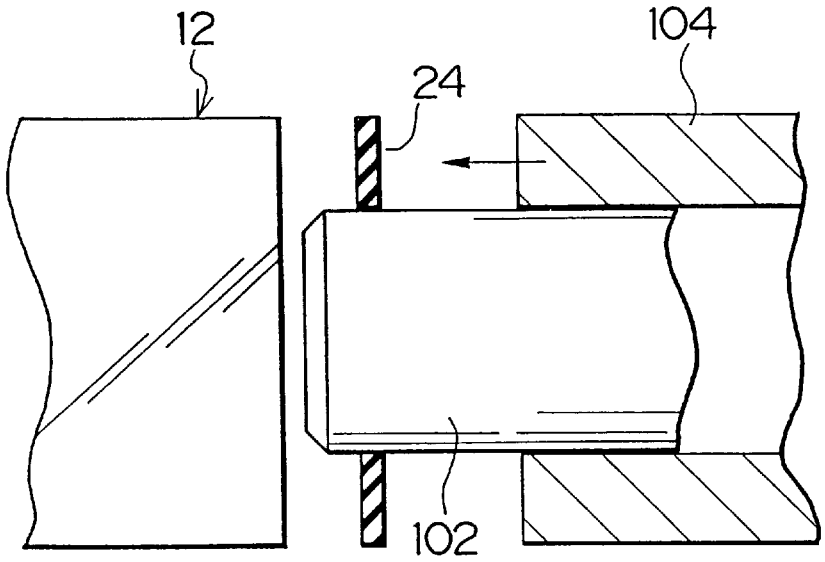
FIG. 12 is a view of assistance for explaining the attachment of the outer seal by the sticking apparatus.
Figure 13:
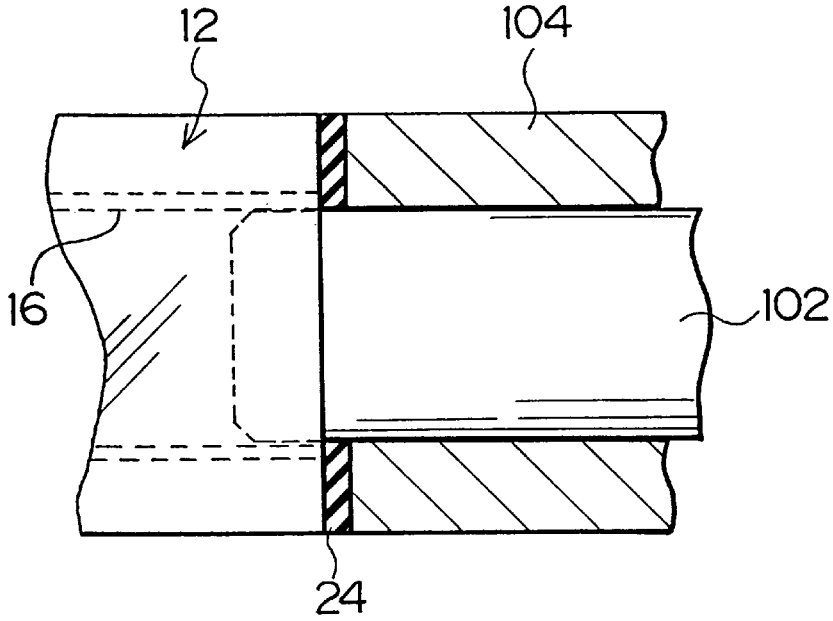
FIG. 13 is a view of assistance for explaining the attachment of the outer seal by the sticking apparatus.

An explanation will hereunder be given about the action of the outer seal sticking apparatus 22. First, when the holding shaft 102 holds the outer seal 24 as shown in FIG. 11, the arm 78 moves away from the holding shaft 102 as shown in FIG. 12. That is, the arm 78 moves to the position to receive the next outer seal 24 from the arm 76. Next, the holding shaft 102 further extends in the second step of extension, and engages with the core 16 of the photographic film roll 12 which has been transported to the position facing the extended holding shaft 102. Thereby, the photographic film roll 12 is fixed. Thereafter, as shown in FIG. 13, the press shaft 104 extends to the photographic film roll 12. Thereby, the outer seal 24 is pressed down onto the end face of the photographic film roll 12 by the press shaft 104. The pressed outer seal 24 is heat-sealed at the station S10 in FIG. 2, and is cooled at the station S11.

Next, an explanation will be given about the operation of the wrapping apparatus 10 which is constructed in the above-mentioned manner with reference to FIGS. 5–8.

Before the transport of the photographic film roll 12 (see FIG. 4), the shaft 30 of the wrapping apparatus 10 is retracted behind the tool support plate 28, and the folding units 32, the heating units 34 and the cooling units 36 are retracted away from the shaft 30. Hence, the photographic film roll 12 which has been transported from the station S4 (see FIG. 2) can be properly positioned in the wrapping apparatus 10 without being interfered by the shaft 30, the folding units 32, the heating units 34 and the cooling units 36.

Then, the shaft 30 moves forward beyond the tool support plate 28, and holds the core 16 of the photographic film roll 12, so that the photographic film roll 12 can be held in the wrapping apparatus 10.

Next, the folding units 32 move toward the shaft 30, and the folding units 32 stop moving when the stopper rollers 48 abut against the outer peripheral surface of the roll of the light-shielding sheet 14 which is wound around the photographic film roll 12. Thereby, the folding blades 46 of the folding units 32 abut against the protruding part 15 of the light-shielding sheet 14. In this state, the folding blades 46 are rotated in the direction of an arrow in FIG. 8, and the shaft 30 is rotated so that the photographic film roll 12 can rotate in the direction of an arrow in FIG. 8. Thus, the protruding part 15 is folded down onto the end face of the photographic film roll 12.

Just before the fronts of the folded parts 15A, which are folded down by the folding blades 46, pass the heating units 34, the heating units 34 move toward the shaft 30. The heating rollers 58 of the heating units 34 heat the folded parts 15A, thereby heat-sealing the folded parts 15A with the thermoplastic adhesive previously coated on the light-shielding sheet 14. Then, following the heating units 34, the cooling units 36 move toward the shaft 30, and the cooling rollers 68 rapidly cool the folded parts 15A which have been heated by the heating rollers 58, thereby preventing the folded parts 15A from loosening. Thus, the folded parts 15A are stuck to the end face of the photographic film roll 12 without fail.

Since two sets of the folding unit 32, the heating unit 34 and the cooling unit are arranged symmetrical with respect to the shaft 30, a rotational angle of the photographic film roll 12 for folding the whole protruding part 15 may be about 200°.

As stated above, in the wrapping apparatus 10 of this embodiment, the folding unit 32 is constructed independently of the heating unit 34. Hence, compared to the conventional apparatus which uses one member as both the heating means and the folding means, it is much easier to position the folding unit 32 and the heating unit 34. In this embodiment, neither the folding unit 32 nor the heating unit 34 damages the photographic film roll 12 in the process of wrapping the photographic film roll 12.

In the wrapping apparatus 10 of this embodiment, the photographic film roll 12 is rotated with respect to the units 32–36, but the units 32–36 may be rotated around the shaft 30 with the photographic film roll 12 being fixed. If the photographic film roll 12 and the units 32–36 are rotated relatively to one another, the photographic film roll 12 can be efficiently wrapped.

In the above explanations, the wrapping apparatus is used for the roll of the photosensitive web such as photographic film, but the present invention should not be restricted to this. Any type of web roll may be wrapped.

As set forth hereinabove, according to the web roll wrapping apparatus of the present invention, the folding means is constructed independently of the heating means. After the folding means folds down the protruding part of the sheet wound around the web roll, the heating means heat-seals the folded part of the seat. Contrary to the conventional apparatus which uses one member as the folding means and the heating means, the web roll can be wrapped without being damaged.

In addition, the mechanisms can be simple and reliable, and the time required for operation can be reduced, thereby improving the efficiency.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A web roll wrapping apparatus for wrapping a web roll in a sheet, the web roll being composed of a web wound around a core, the sheet being (1) wound around an outer peripheral surface of the web roll, such that a protruding part of the sheet protrudes from an end face of the web roll, and (2) previously coated with a thermoplastic adhesive, said web roll wrapping apparatus comprising:

a roll holding member for holding the web roll by engaging with the core;

folding means for folding down the protruding part of the wound sheet onto the end face of the web roll to create a folded part of the sheet; and heating means for heating the folded part of the sheet to heat-seal the folded part with the thermoplastic adhesive, said heating means arranged adjacent to said folding means;

wherein said folding means and said heating means are independently moveable.

2. The web roll wrapping apparatus as defined in claim 1, further comprising:

a tool supporting member for supporting said folding means and said heating means; and driving means for rotating at least one of said roll holding member and said tool supporting member around an axis of the web roll;

wherein, while said driving means is rotating at least one of said roll holding member and said tool supporting member, said folding means folds down the protruding part of the wound sheet and said heating means heats the folded part of the sheet.

3. The web roll wrapping apparatus as defined in claim 2, wherein at least two sets of said folding means and said heating means are provided on said tool supporting member.

4. The web roll wrapping apparatus as defined in claim 2, wherein said folding means and said heating means are supported on said tool supporting member in a manner to move toward and away from said roll holding member.

5. The web roll wrapping apparatus as defined in claim 4, further comprising:

a positioning member provided at each of said folding means and said heating means;

wherein, when said folding means moves toward said roll holding member, said positioning member of said folding means abuts against an outer peripheral surface of the wound sheet to position said folding means at the protruding part of the wound sheet; and wherein, when said heating means moves toward said roll holding member, said positioning member of said heating means abuts against the outer peripheral surface of the wound sheet to position said heating means at the folded part of the sheet.

6. The web roll wrapping apparatus as defined in claim 5, wherein at least two sets of said folding means and said heating means are provided on said tool supporting member.

7. The web roll wrapping apparatus as defined in claim 1, further comprising cooling means for cooling the heated part of the sheet, said cooling means being arranged adjacent to said heating means.

8. The web roll wrapping apparatus as defined in claim 7, further comprising:

a tool supporting member for supporting said folding means, said heating means and said cooling means; and driving means for rotating at least one of said roll holding member and said tool supporting member around an axis of the web roll;

wherein, while said driving means is rotating at least one of said roll holding member and said tool supporting member, (1) said folding means folds down the protruding part of the wound sheet, (2) said heating means heats the folded part of the sheets and (3) said cooling means cools the heated part of the sheet.

9. The web roll wrapping apparatus as defined in claim 8, wherein at least two sets of said folding means, said heating means and said cooling means are provided on said tool supporting member.

10. The web roll wrapping apparatus as defined in claim 8, wherein said folding means, said heating means and said cooling means are supported on said tool supporting member in a manner to move toward and away from said roll holding member.

11. The web roll wrapping apparatus as defined in claim 10, further comprising:

a positioning member provided at each of said folding means, said heating means and said cooling means;

wherein, when said folding means moves toward said roll holding member, said positioning member of said folding means abuts against an outer peripheral surface of the wound sheet to position said folding means at the protruding part of the wound sheet;

wherein, when said heating means moves toward said roll holding member, said positioning member of said heating means abuts against the outer peripheral surface of the wound sheet to position said heating means at the folded part of the sheet; and wherein, when said cooling means moves toward said roll holding member, said positioning member of said cooling means abuts against the outer peripheral surface of the wound sheet to position said cooling means at the heated part of the sheet.

12. The web roll wrapping apparatus as defined in claim 11, wherein at least two sets of said folding means, said heating means and said cooling means are provided on said tool supporting member.

13. The web roll wrapping apparatus as defined in claim 1, further comprising sticking means for sticking a disk seal member on the end face of the web roll so as to cover the end face of the web roll.

14. The web roll wrapping apparatus as defined in claim 1, wherein said folding means includes a plurality of rotatable blades.

15. A web roll wrapping apparatus for wrapping a web roll in a sheet, the web roll being composed of a web wound around a core, the sheet being (1) wound around an outer peripheral surface of the web roll, such that a protruding part of the sheet protrudes from an end face of the web roll, and (2) previously coated with a thermoplastic adhesive, said web roll wrapping apparatus comprising:

a roll holding member for holding the web roll by engaging with the core;

a folding unit for folding down the protruding part of the wound sheet onto the end face of the web roll to create a folded part of the sheet; and a heating unit for heating the folded part of the sheet to heat-seal the folded part with the thermoplastic adhesive, said heating unit arranged adjacent to said folding unit;

wherein said folding unit and said heating unit are independently moveable.

16. The web roll wrapping apparatus as defined in claim 15, further comprising:

a tool supporting member for supporting said folding unit and said heating unit; and a driving unit for rotating at least one of said roll holding member and said tool supporting member around an axis of the web roll;

wherein, while said driving unit is rotating at least one of said roll holding member and said tool supporting member, said folding unit folds down the protruding part of the wound sheet and said heating unit heats the folded part of the sheet.

17. The web roll wrapping apparatus as defined in claim 16, wherein at least two sets of said folding unit and said heating unit are provided on said tool supporting member.

18. The web roll wrapping apparatus as defined in claim 16, wherein said folding unit and said heating unit are supported on said tool supporting member in a manner to move toward and away from said roll holding member.

19. The web roll wrapping apparatus as defined in claim 18, further comprising:

a positioning member provided at each of said folding unit and said heating unit;

wherein, when said folding unit moves toward said roll holding member, said positioning member of said folding unit abuts against an outer peripheral surface of the wound sheet to position said folding unit at the protruding part of the wound sheet; and wherein, when said heating unit moves toward said roll holding member, said positioning member of said heating unit abuts against the outer peripheral surface of the wound sheet to position said heating unit at the folded part of the sheet.

20. The web roll wrapping apparatus as defined in claim 19, wherein at least two sets of said folding unit and said heating unit are provided on said tool supporting member.

21. The web roll wrapping apparatus as defined in claim 15, further comprising a cooling unit for cooling the heated part of the sheet, said cooling unit being arranged adjacent to said heating unit.

22. The web roll wrapping apparatus as defined in claim 21, further comprising:

a tool supporting member for supporting said folding unit, said heating unit and said cooling unit; and a driving unit for rotating at least one of said roll holding member and said tool supporting member around an axis of the web roll;

wherein, while said driving unit is rotating at least one of said roll holding member and said tool supporting member, (1) said folding unit folds down the protruding part of the wound sheet, (2) said heating unit heats the folded part of the sheet, and (3) said cooling unit cools the heated part of the sheet.

23. The web roll wrapping apparatus as defined in claim 22, wherein at least two sets of said folding unit, said heating unit and said cooling unit are provided on said tool supporting member.

24. The web roll wrapping apparatus as defined in claim 22, wherein said folding unit, said heating unit and said cooling unit are supported on said tool supporting member in a manner to move toward and away from said roll holding member.

25. The web roll wrapping apparatus as defined in claim 24, further comprising:

a positioning member provided at each of said folding unit, said heating unit and said cooling unit;

wherein, when said folding unit moves toward said roll holding member, said positioning member of said folding unit abuts against an outer peripheral surface of the wound sheet to position said folding unit at the protruding part of the wound sheet;

wherein, when said heating unit moves toward said roll holding member, said positioning member of said heating unit abuts against the outer peripheral surface of the wound sheet to position said heating unit at the folded part of the sheet; and wherein, when said cooling unit moves toward said roll holding member, said positioning member of said cooling unit abuts against the outer peripheral surface of the wound sheet to position said cooling unit at the heated part of the sheet.

26. The web roll wrapping apparatus as defined in claim 25, wherein at least two sets of said folding unit, said heating unit and said cooling unit are provided on said tool supporting member.

27. The web roll wrapping apparatus as defined in claim 15, further comprising a sticking unit for sticking a disk seal member on the end face of the web roll so as to cover the end face of the web roll.

28. The web roll wrapping apparatus as defined in claim 15, wherein said folding unit includes a plurality of rotatable blades.

* * * * *